US006289651B1

(12) United States Patent
Le Bras

(10) Patent No.: US 6,289,651 B1
(45) Date of Patent: Sep. 18, 2001

(54) PANEL INTERLOCKING MEANS FOR CARTONS

(75) Inventor: Philippe Le Bras, Chateauroux (FR)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/355,900

(22) PCT Filed: Feb. 6, 1998

(86) PCT No.: PCT/US98/02358

§ 371 Date: Oct. 8, 1999

§ 102(e) Date: Oct. 8, 1999

(87) PCT Pub. No.: WO98/34850

PCT Pub. Date: Aug. 13, 1998

(30) Foreign Application Priority Data

Feb. 7, 1997 (GB) ..... 9702567
Feb. 26, 1997 (GB) ..... 9704021

(51) Int. Cl.[7] ..... B60G 5/00

(52) U.S. Cl. ..... 53/394; 493/136; 493/137; 493/390

(58) Field of Search ..... 493/136, 137, 493/390; 206/427, 428; 229/185; 53/394

(56) References Cited

U.S. PATENT DOCUMENTS 3,793,928 * 2/1974 Wooten .
4,004,500 * 1/1977 Wood .
4,062,270 * 12/1977 Culpepper .
4,429,486 * 2/1984 Bjornstad .
5,004,147 4/1991 Bienaime ..... 229/198.2
5,472,138 * 12/1995 Ingram .
5,595,292 1/1997 Bates ..... 206/158
5,611,425 * 3/1997 Holley, Jr. .

FOREIGN PATENT DOCUMENTS 321181 11/1997 (TW) ..... 206/736

* cited by examiner

*Primary Examiner*—Eugene Kim
(74) *Attorney, Agent, or Firm*—Tsugihiko Suzuki

(57) ABSTRACT

Panel interlocking means secures together first and second panels in overlapping relationship. The first panel comprises a locking tab struck therefrom adjacent the free edge thereof The locking tab extends away from the free edge of the first panel and defines a first aperture in the first panel. The locking tab has a neck portion hinged at its base to the first panel and terminates in its shoulder portion. The second panel includes a second aperture struck therefrom adjacent the free edge thereof. The second aperture receives the locking tab such that when the panels are locked together, the free edge of the second panel is located along the locking tab between the base of the neck portion and the shoulder portion, and the locking tab is engaged with an edge of the first aperture.

9 Claims, 2 Drawing Sheets

PANEL INTERLOCKING MEANS FOR CARTONS

Figure 1:
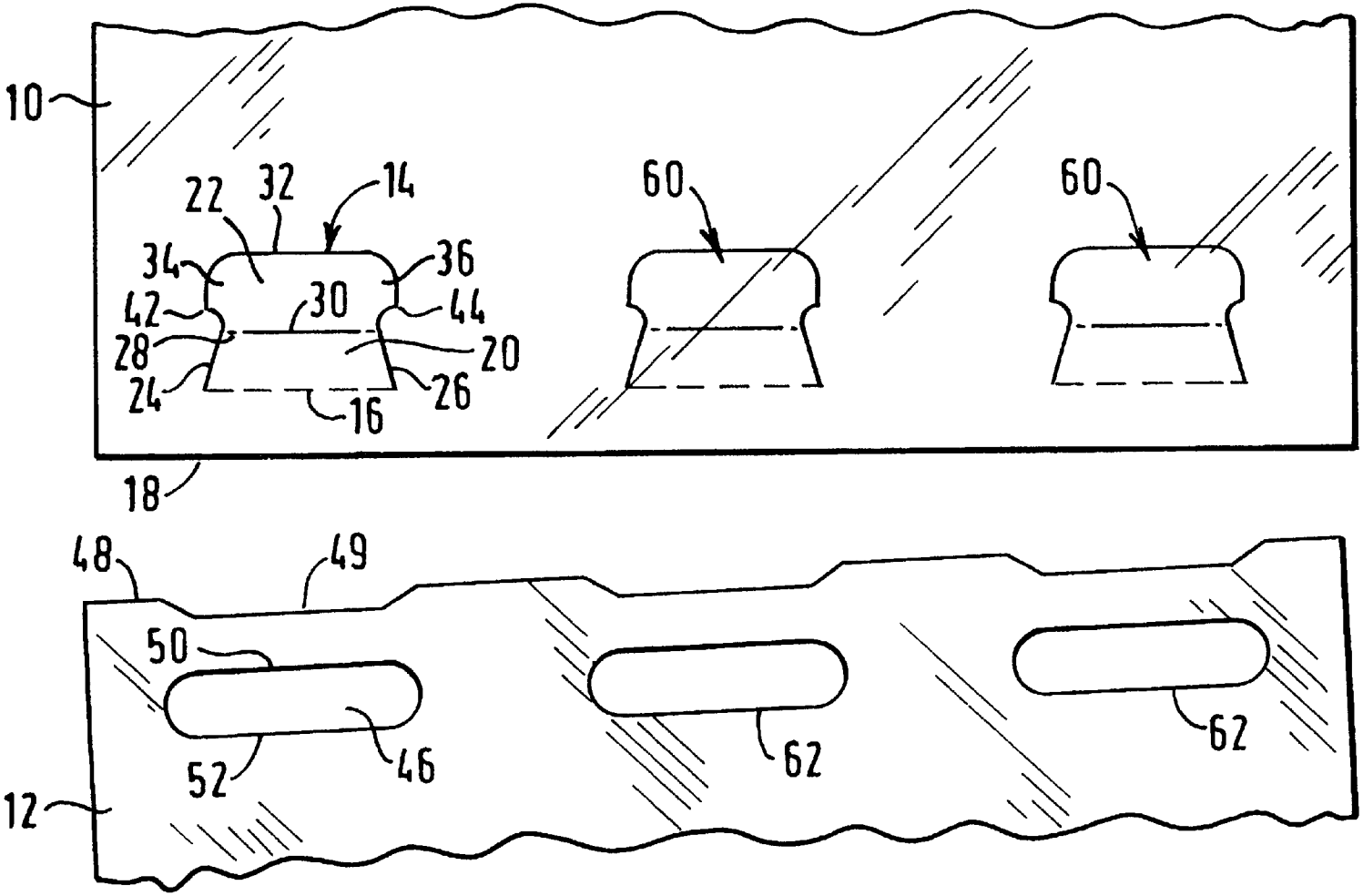

This invention relates to panel interlocking means for securing together a pair of panels, for example, adjacent overlapping panels of a paperboard carton. In some situations, these panels are provided by the opposite ends of a wrapper blank which are brought together in overlapping relationship and interlocked.

Locking tabs which are struck from one end of the carton wrapper and which are arranged to be driven through corresponding apertures defined by retaining tabs, struck from an opposite end of a wrapper are well known. However, in the present invention, the interlocking of panels is effected by causing a locking tab to be engaged through an aperture. In the present invention, locking tabs are directed away from the free end of their respective panel, such configurations are known, for example, U.S. Pat. No. 3,351,263 (Wood). This application shows a locking arrangement in which a first panel includes a locking tab which is directed away from free end of the first panel. A second panel includes a first aperture through which the tab is passed and then passed over a portion of the panel located beyond the aperture and is inserted through a second aperture in select combination.

A problem associated with known locking arrangements is that the forming of such locking arrangements is complicated and requires additional features, for example, additional retaining means or apertures. The more complicated arrangements also require precise registration of the two panels that are to be interlocked.

The present invention seeks to mitigate the problems outlined above by providing a simplified but secure locking arrangement.

One aspect of the present invention provides panel interlocking means for securing together a first and a second panel in overlapping relationship, the first panel comprising a locking tab struck from the first panel adjacent a free edge thereof and extending away from the free edge of the first panel. The locking tab has a neck portion hinged at a base thereof to the first panel and terminating in a shoulder portion and wherein the second panel includes an aperture struck from the second panel adjacent a free edge thereof and wherein the aperture is adapted to receive the locking tab such that when the panels are locked together the free edge of the second panel, outboard of the aperture, is located along the locking tab between the base of the neck portion and the shoulder portion.

According to an optional feature of this aspect of the invention the neck portion may include a transverse fold line so that the shoulder portion is hinged relative to the neck portion.

According to another optional feature of this aspect of the invention a locking edge may be formed between the underside of the shoulder portion and the neck portion. Preferably, the locking edge is adapted to interengage with a complementary edge of an aperture of the first panel which was created by the formation of the locking tab Another aspect of the present invention provides panel interlocking means for securing together a first panel and a second panel in overlapping relationship, the first panel comprising a locking tab struck from the fit panel adjacent to the free edge thereof and extending away from the free edge of the first panel, the locking tab having a neck portion hinged at a base thereof to the first panel and terminating in a shoulder portion, and wherein the second panel includes an aperture struck from the second panel adjacent the free edge thereof, and wherein the aperture is adapted to receive the locking tab such that the locking tab overlaps part of the second panel between the aperture and the free edge, and wherein a locking edge of the locking tab is provided at each of the opposed side edges of the locking tab at the transition between the neck portion and the shoulder portion to interengage with complementary edges of an aperture created by formation of the locking tab to maintain the first panel and the second panel in a locked overlapped relationship.

According to an optional feature of this aspect of the invention, the neck portion may include a transverse fold line so that the shoulder portion is hinged relative to the neck portion adjacent the locking edges.

According to another optional feature of this aspect of the invention, the locking edges of and the complementary edges may be curvilinear.

Another aspect of the invention provides a method of securing together a first panel and a second panel in overlapping relationship, the first panel comprising a locking tab struck from the first panel adjacent a free edge thereof and extending away from the free edge of the first panel, the locking tab having a neck portion hinged at the base thereof to the first panel adjacent the free edge and terminating in a shoulder portion, and wherein the second panel includes an aperture struck from the second panel adjacent a free edge thereof, which method comprises the following steps: (i) folding the locking tab out of the plane of the first panel and towards the free edge thereof; (ii) bringing the first and second panels into overlapping relationship so that the aperture and locking tab are brought into registry; (iii) inserting the locking tab through the aperture; and (iv) folding the locking tab into overlapping relationship with the second panel between the aperture and free edge thereof towards its original position and inserting it through the aperture from which the locking tab was struck such that the locking tab is interengaged with an edge portion of the tab aperture such that the first and second panels are locked together in overlapping relationship. Preferably, the free edge of the second panel outboard of the aperture is located along the locking tab between the base of the neck portion and the shoulder portion.

Another aspect of the invention provides a carton blank incorporating panel interlocking means having a first panel and a second panel, the first panel comprising a locking tab struck therefrom including a neck portion and a shoulder portion, the neck portion being positioned adjacent to the free edge of the first panel and hinged to the first panel by a fold line at the base of the neck portion and wherein opposed side edges of the locking tab at the transition between the neck portion and shoulder portion are each shaped to define a locking edge extending from the tab to cooperate with an adjacent locking edge formed in the first panel and wherein a locking aperture is struck from the second panel spaced from its free edge to receive the locking tab.

According to an optional feature of this aspect of the invention, said neck portion may include a transverse fold line so that said shoulder portion is hinged relative to the neck portion.

According to another optional feature of this aspect of the invention, there may further comprise a locking edge formed between the underside of said shoulder portion and said neck portion, said locking edge being adapted to internegage with a complementary edge of an aperture of the first panel which was created by the formation of said locking tab. Preferably, said locking edges and said complementary edges are curvilinear.

Figure 4:
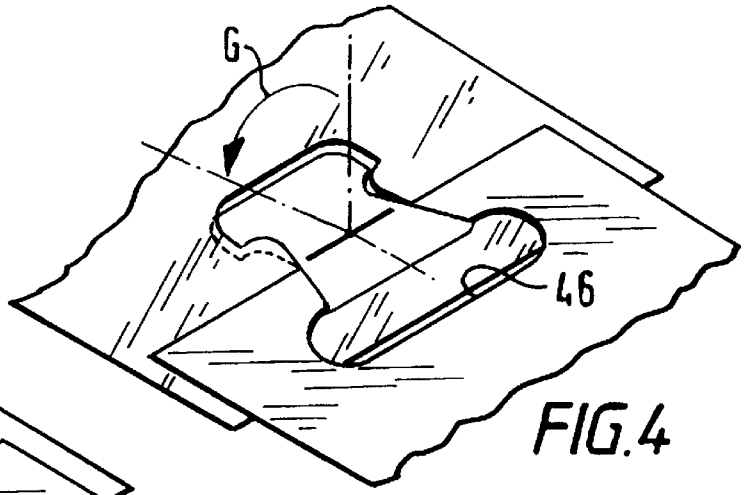
Figure 3:
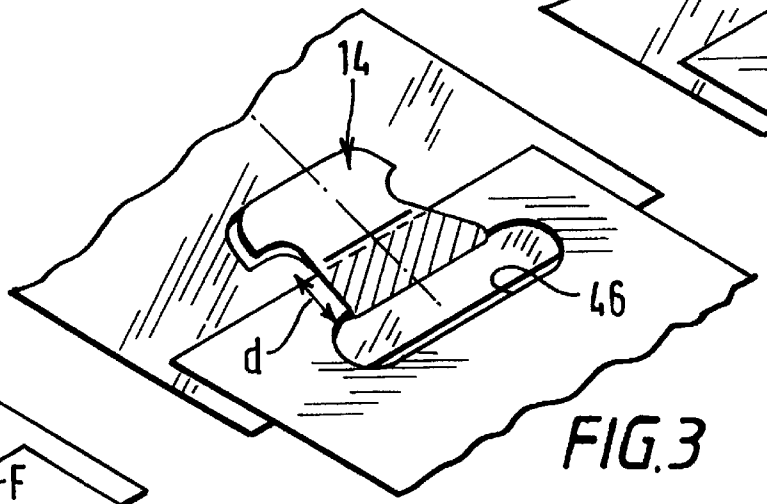
Figure 2:
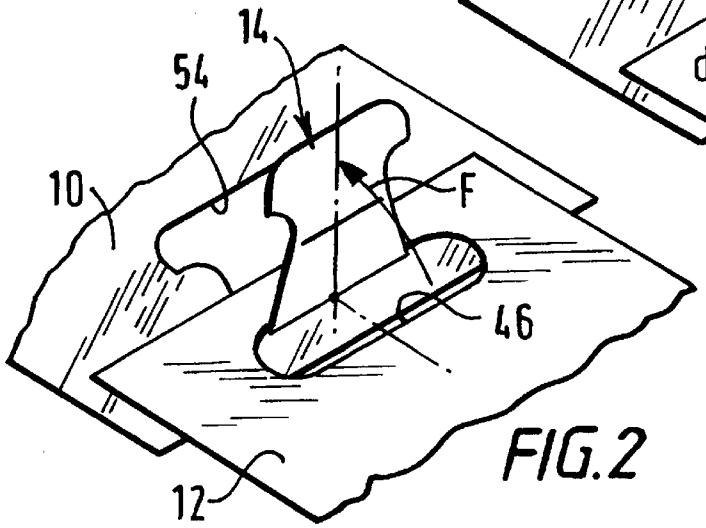

An embodiment of the invention will now be described, by way of example only, in which:

FIG. 1 shows a pair of panels which are positioned opposite ends of a carton blank, in close proximity, one of which includes a locking tab and the other of which includes locking apertures; and FIGS. 2, 3 and 4 are perspective views of part of the panels illustrated in FIG. 1 showing the various stages of interlocking the two panels.

Referring to the drawings, a pair of panels 10, 12 respectively are adapted to be placed in an overlapping relationship and interlocked and are formed from paperboard or similar foldable sheet material. The panels 10, 12 may, for example, be disposed at the opposite ends of one and the same carton blank which is to be formed into a carton sleeve in which panels 10, 12 then provide bottom panels of die carton. The carton is used for packaging a plurality of articles, for example, cans. It is envisaged that the panel interlocking means for securing together a first and second panel can be incorporated into a variety of carton types, for example wraparound, basket or fully enclosed without departing from the scope of invention.

Locking tab 14 is struck from panel 10 and is hingeably coated thereto by fold line 16 with the locking tab extending away from the free edge. In this embodiment, the fold line 16 is substantially parallel to and spaced from the end edge 18 of panel 10. The locking tab 14 comprises a neck portion 20 and a "shoulder" or main portion 22. The neck portion 20 is hingeably connected to first panel 10 along fold line 16. As shown in FIG. 1, a pair of oppositely disposed cut lines 24, 26 define the side edges of the neck portion 20 and the main portion 22 is hingeably connected to neck portion 20 along a transverse fold line 28 which is substantially parallel to fold line 16. Optionally, fold line 28 is separated by a cut line 30 to make folding the shoulder portion 22 easier.

The shoulder portion 22 is separated from panel 10 by a cut line 32 which in this embodiment is substantially "D shaped": the cut line 32 can also define a pair of interlocking parts 34, 36 positioned along the opposing side edges of shoulder portion 22. Preferably, the cut lines 24, 26 are curvilinear to define a pair of oppositely disposed an anchor tabs 38, 40 connected to first panel 10 and positioned adjacent to side edges of neck portion 20. Thus, at the intersection of cut lines 24 and 30 and cut lines 26 and 30, a locking edge 42, 44 which in this embodiment is substantially hook shaped is formed for interlocking parts 24, 26 respectively.

As shown in FIG. 1, an aperture 46 which is preferably elongate in shape, is struck from panel 12, being substantially parallel to the free edge 48 of second panel 12 and comprising a front edge 50 and a rear edge 52, the front edge 50 being nearer to the free edge 48 of panel 12. Preferably, the front edge 50 of aperture 46 is spaced from the free edge 48 of panel 12 by a distance d which corresponds approximately to the length of neck portion 20 (shown in FIG. 3). In this embodiment, the free edge 48 is formed with an indentation 49 so that the distance is reduced to the correct dimensions outlined above. In this embodiment, there are two further locking tabs 60 and apertures 62 which are substantially identical to locking tabs 14 and aperture 46 and are not therefore described in any greater detail.

Turning to the construction of the panel interlocking means, illustrated in FIGS. 2 to 4, the blank requires a series of sequential folding operations. The folding process is not limited to that described below and can be altered according to the particular manufacturing requirements.

One method of locking together panels 10 and 12 is first fold the locking tab 14 about fold line 16 into a substantially face contacting overlapping relationship with portion of first panel 10. The panels 10 and 12 are brought into an overlapping relationship with each other, and locking tab 14 can then be folded out of alignment with panel 10 and through aperture 46, as illustrated in FIG. 2. It will be appreciated by those skilled in the art that the locking tab may be an interference fit with the locking aperture. One advantage of the present invention is that the locking process does not require precise registration of the two panels 10 and 12, because locking tab 14 is self locking in its own aperture.

The natural resilience of the paperboard material then allows the locking tab to automatically spring back in the direction F into its original position as shown in FIG. 3. Optionally, guide means is used if manufacturing requirements or the carton design means that the locking tab 14 needs to be guided back to its original position. Optionally, the shoulder portion 22 of locking tab 14 is folded out of alignment with neck portion 20 along fold line 24. In this embodiment, locking tab 14 is pushed in the direction G through the aperture 54 created by the formation of locking tab 14 such that the interlocking parts 34, 36 and the anchor tab 38, 40 may interengage, as shown in FIG. 4.

Tension is applied to the panels in opposition to the locking direction, i.e. in a direction tending to move the panels apart. Thus, the butt engagement between the interlocking parts 34, 36 and the anchoring tabs 38, 40 maintain the locking tab 14 in its locked condition. Panels 10, 12 remain interlocked because the front edge of aperture 46 is located along the locking tab 14 between the base of the neck portion and the shoulder portion 22 and, preferably, in butt engagement with fold line 16 of panel 10.

Thus, the free edge of panel 12, outboard of the aperture 48 is located along the locking tab between the base of the neck portion and the shoulder portion.

Further, or alternatively, the locking tab overlaps part of the second panel between said aperture and said free edge, and wherein a locking edge of the locking tab is provided at each of the opposed side edges of the locking tab at the transition between the neck portion and the shoulder portion to interengage with the free edge of the second panel outboard of said aperture located along the locking tab between the base of said neck portion and said shoulder portion.

The present invention and its preferred embodiment relates to a means of locking two adjacent panels in a wraparound carton and is shaped to provide satisfactory strength to maintain the panels in a locked position but with a degree of flexibility so that the load transferred to the panels is absorbed by the carrier. The shape of the blank minimises the amount of paperboard required. The carrier can be formed by hand or automatic machinery. It is anticipated that the invention can be applied to a variety of carriers not limited to those of the wraparound type.

What is claimed is:

1. Panel interlocking means for securing together first and second panels in overlapping relationship, said first panel comprising a locking tab struck from said first panel adjacent a free edge thereof and extending away from the free edge of said first panel, the locking tab defining a first aperture in said first panel, the locking tab having a neck portion hinged at a base thereof to said first panel and terminating in a shoulder portion, wherein said second panel includes a second aperture struck from said second panel adjacent a free edge thereof, wherein said second aperture is adapted to receive the locking tab such that when the panels are locked together the free edge of said second panel, outboard of said second aperture, is located along the locking tab between the base of said neck portion and said shoulder portion, and wherein said locking tab comprises a locking edge adapted to engage with a complementary edge of said first aperture of the first panel.

2. The panel interlocking means according to claim 1 wherein said neck portion includes a transverse fold line so that said shoulder portion is hinged relative to the neck portion.

3. The panel interlocking means according to claim 1 wherein said locking edge is formed between the underside of said shoulder portion and said neck portion.

4. Panel interlocking means for securing together a first panel and a second panel in overlapping relationship, said first panel comprising a locking tab struck from said first panel adjacent to a free edge thereof and extending away from the free edge of said first panel, said locking tab defining a first aperture in said first panel, said locking tab having a neck portion hinged at a base thereof to said first panel and terminating in a shoulder portion, wherein said second panel includes a second aperture struck from said second panel adjacent a free edge thereof, wherein said second aperture is adapted to receive the locking tab such that the free edge of said second panel is located along the locking tab between the base of said neck portion and said shoulder portion, and wherein said locking tab comprises a locking edge at each of opposed side edges of the locking tab at a transition between the neck portion and the shoulder portion to engage with complementary edges of said first aperture to maintain said first panel and said second panel in a locked overlapped relationship.

5. The panel interlocking means according to claim 4 wherein said neck portion includes a transverse fold line so that said shoulder portion is hinged relative to the neck portion adjacent said locking edges.

6. The panel interlocking means according to claim 4 wherein said locking edges and said complementary edges are curvilinear.

7. A carton comprising first and second overlapping panels and panel interlocking means for securing said first and second panels together, said first panel comprising a locking tab struck from said first panel adjacent a free edge thereof and extending away from the free edge of said first panel, said locking tab defining a first aperture in said first panel, the locking tab having a neck portion hinged at a base thereof to said first panel and terminating in a shoulder portion, wherein said second panel includes a second aperture struck from said second panel adjacent a free edge thereof, wherein the locking tab is received in the second aperture and overlaps part of the second panel between said second aperture and said free edge of said second panel such that the free edge of said second panel is located along the locking tab between the base of said neck portion and said shoulder portion, and wherein said locking tab includes a locking edge disposed in engagement with a complementary edge of said first aperture.

8. The carton according to claim 7 wherein said locking edge is formed at each of opposed side edges of said locking tab at a transition between said shoulder portion and said neck portion.

9. A method of securing together a first panel and a second panel in overlapping relationship, said first panel comprising a locking tab struck from said first panel adjacent a free edge thereof and extending away from the free edge of said first panel, the locking tab defining a first aperture in said first panel, the locking tab having a neck portion hinged at a base thereof to said first panel and terminating in a shoulder portion, and wherein said second panel includes a second aperture struck from said second panel adjacent a free edge thereof, which method comprises the following steps:

(i) folding the locking tab out of the plane of the first panel and towards said free edge of the first panel;

(ii) bringing the first and second panels into overlapping relationship so that the second aperture and locking tab are brought into registry;

(iii) inserting the locking tab through said second aperture;

(iv) folding the locking tab towards said first aperture till the free edge of said second panel is located along the locking tab between the base of said neck portion and said shoulder portion; and (v) inserting the locking tab through said first aperture such that the locking tab is engaged at a locking edge thereof with a complementary edge of said first aperture whereby the first and second panels are locked together in overlapping relationship.

* * * * *